United States Patent [19]

Schneck et al.

[11] Patent Number: 4,534,151

[45] Date of Patent: Aug. 13, 1985

[54] METHOD AND APPARATUS FOR PACKAGING PAPER ROLLS

[75] Inventors: Hans Schneck; Esko Tiitinen, both of Varkaus, Finland

[73] Assignee: A. Ahlstrom Osakeyhtio, Noormarkku, Finland

[21] Appl. No.: 514,802

[22] PCT Filed: Oct. 25, 1982

[86] PCT No.: PCT/FI82/00048

§ 371 Date: Jul. 13, 1983

§ 102(e) Date: Jul. 13, 1983

[87] PCT Pub. No.: WO83/01765

PCT Pub. Date: May 26, 1983

[30] Foreign Application Priority Data

Nov. 16, 1981 [FI] Finland ..... 813607

[51] Int. Cl.[3] ..... B65B 11/04; B65B 51/06; B65B 61/00

[52] U.S. Cl. ..... 53/415; 53/137; 53/139.3; 53/211; 53/419; 53/465; 82/47; 82/83; 82/86; 82/101; 83/187; 493/82; 493/342

[58] Field of Search ..... 53/211, 214, 215, 137, 53/139.3, 380, 415, 419, 465; 82/46, 47, 52, 101; 83/187, 916; 493/82, 342

[56] References Cited

U.S. PATENT DOCUMENTS

| | | | |
|---|---|---|---|
| 2,368,213 | 1/1945 | Gerlach | 53/137 |
| 3,633,335 | 1/1972 | Johnson | 53/380 |
| 4,137,690 | 2/1979 | Morgan | 53/211 |

FOREIGN PATENT DOCUMENTS

| | | |
|---|---|---|
| 338010 | 8/1971 | Sweden . |
| 394409 | 6/1977 | Sweden . |
| 2004245 | 8/1978 | United Kingdom . |

*Primary Examiner*—Robert L. Spruill
*Assistant Examiner*—Richard M. Mudd
*Attorney, Agent, or Firm*—Bucknam and Archer

[57] ABSTRACT

A method and an apparatus for packaging paper rolls (2), wherein a wrapper sheet (1) of such a size as to exceed the axial length of the roll is wrapped around the roll and the width of the wrapper sheet is reduced to a size corresponding to the length of the roll by removing the part (5, 6) of the wrapper sheet which extends over the ends of the roll. The header sheet (14, 15) which is bigger than the end surface of the roll, is placed on the ends of the roll and reduced to a size corresponding to the diameter of the roll or smaller by removing at least the part of the header sheet extending over the end surface. Thereafter the header (14, 15) and the wrapper (25) are secured to each other so that a tight joint is formed.

6 Claims, 5 Drawing Figures

METHOD AND APPARATUS FOR PACKAGING PAPER ROLLS

TECHNICAL FIELD

The present invention relates to a method and an apparatus for packaging paper rolls or the like, comprising the steps of wrapping a wrapper sheet around the roll and securing headers to the roll ends.

BACKGROUND ART

To protect rolls of paper from handling and transport damage, the usual practice is to wrap the rolls with thick paper or board and to cover the roll ends by means of sheets protecting the ends. The package has to protect the roll both against humidity and mechanical damage.

According to the most common prevailing method, the wrapping of paper rolls in paper factories is carried out as follows:

Wrapping paper is wrapped around the paper roll, the width of the paper exceeding the length of the roll. The part of the wrapper extending over the roll ends is pleated inwards toward the centre axis of the roll and folded against the end of the roll so that it at the same time seals in the so called inner header to its place. Hereafter another, outer header is pressed against the outer surface of the the inward bent folds of the wrapper and adhesively secured to the end. A package made this way has, however, been found to be unsatisfactory in some aspects. The part of the wrapper folded against the end is rough and therefore between the wrapper and the header there may remain some channels through which humidity can intrude into the package.

The UK published patent application No. 2004245 discloses another wrapping method in which a header sheet of a size greater than the end surface of the roll is pressed against the roll end face and the parts of the header sheet extending over the end surface are folded against the cylindrical surface of the roll and folded onto said surface. The mantle surface of the roll is wrapped with wrapping material the width of which is approximately the same as the length of the roll and which covers the folded parts of the header. Also this package is susceptible to humidity.

DISCLOSURE OF INVENTION

It is an object of the present invention to provide an improved method for wrapping paper rolls by means of which the deficiencies found in the known art can be eliminated.

The method according to the invention is characterized in that a wrapper sheet the width of which exceeds the axial length of the roll is wrapped around the roll and secured thereto, that the width of the wrapper is reduced to the length of the roll by removing the part of the wrapper sheet extending over the roll ends, that a header sheet bigger than the end surface of the roll is placed against the roll ends, that the size of the header sheets is reduced to that of the diameter of the roll or smaller by removing the part of the header sheet extending over the end surface and that the headers are adhered to the wrapper in such a manner that a tight joint is formed.

The apparatus according to the invention is characterized in that it comprises cutting means provided with shearing and cutting tools to be placed against the roll for removing the edges of the wrapper sheet and the header sheets extending over the roll ends as well as means for feeding the jointing material and securing it to the edges of the wrapper and the headers.

BRIEF DESCRIPTION OF THE DRAWINGS

The invention will be described further in the following with reference to the accompanying drawings in which.

DETAILED DESCRIPTION OF THE BEST MODE FOR CARRYING OUT THE INVENTION

Figure 1:
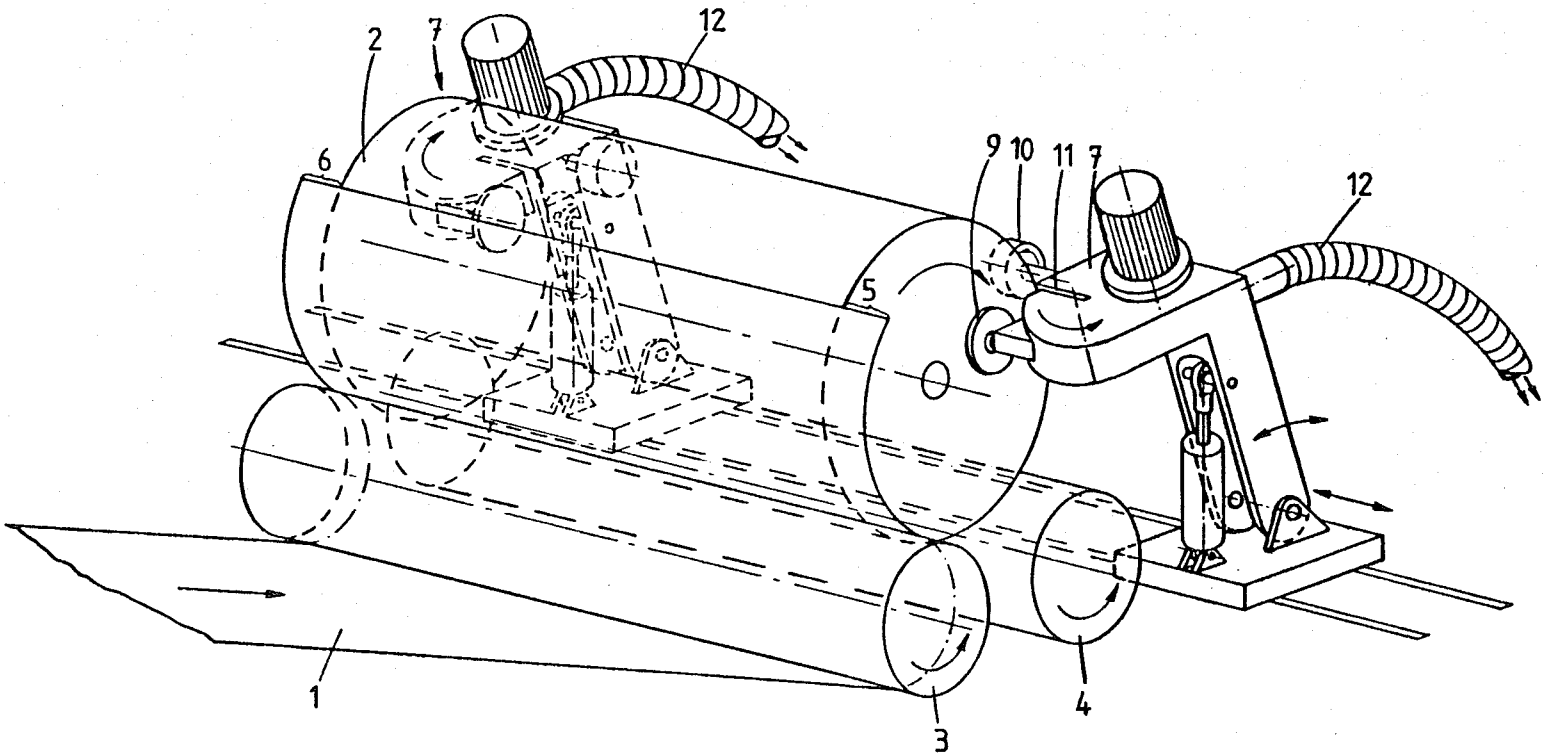
FIG. 1 is a perspective view of a mantle wrapping and cutting means according to the invention.

In FIG. 1 a wrapper sheet 1 the width of which exceeds the length of a paper roll 2 is wrapped around a paper roll 2. The paper roll rests on two rotatable supporting rolls 3 and 4. The wrapping material is preferably coated with a heat activated layer of adhesive, whereby the wrapping material can be adhered onto the surface of the paper roll and the superimposed wrapper layers can be conglutinated by heating the wrapping material by means of electric resistances disposed underneath it. Alternatively, the adhesive can be applied on the wrapping material in a manner known per se, e.g. by spraying it just before wrapping. Wrapping materials of various widths from various wrapper rolls can be fed into the wrapping machine for paper rolls of various lengths.

Parts 5 and 6 extending over the ends of the paper roll are cut off by edge cutting means 7. The cutting means can be moved parallelly with the axis of the paper roll and in a direction perpendicular to the axis. In the beginning of the wrapping phase the cutting means are moved against the paper roll so that a supporting roll 9 of both of the cutting means leans against the end surface and another 10 against the circumference of the roll. Thereby an opening 11 in the direction of the roll axis disposed in the cutting means gets into its place so that while the paper roll rotates, the edge of the wrapping material gets inside said opening. The cutter head of the cutting means cuts off the edge and cuts at the same time into small pieces which are removed through hoses 12.

When a sufficient amount of wrapping material has been wrapped around the paper roll, the wrapping material is cut and the cutting folds of the edge are removed from the roll. Thereafter the wrapped roll is moved to the device shown in FIG. 2 where the securing of the headers is carried out.

Figure 2:
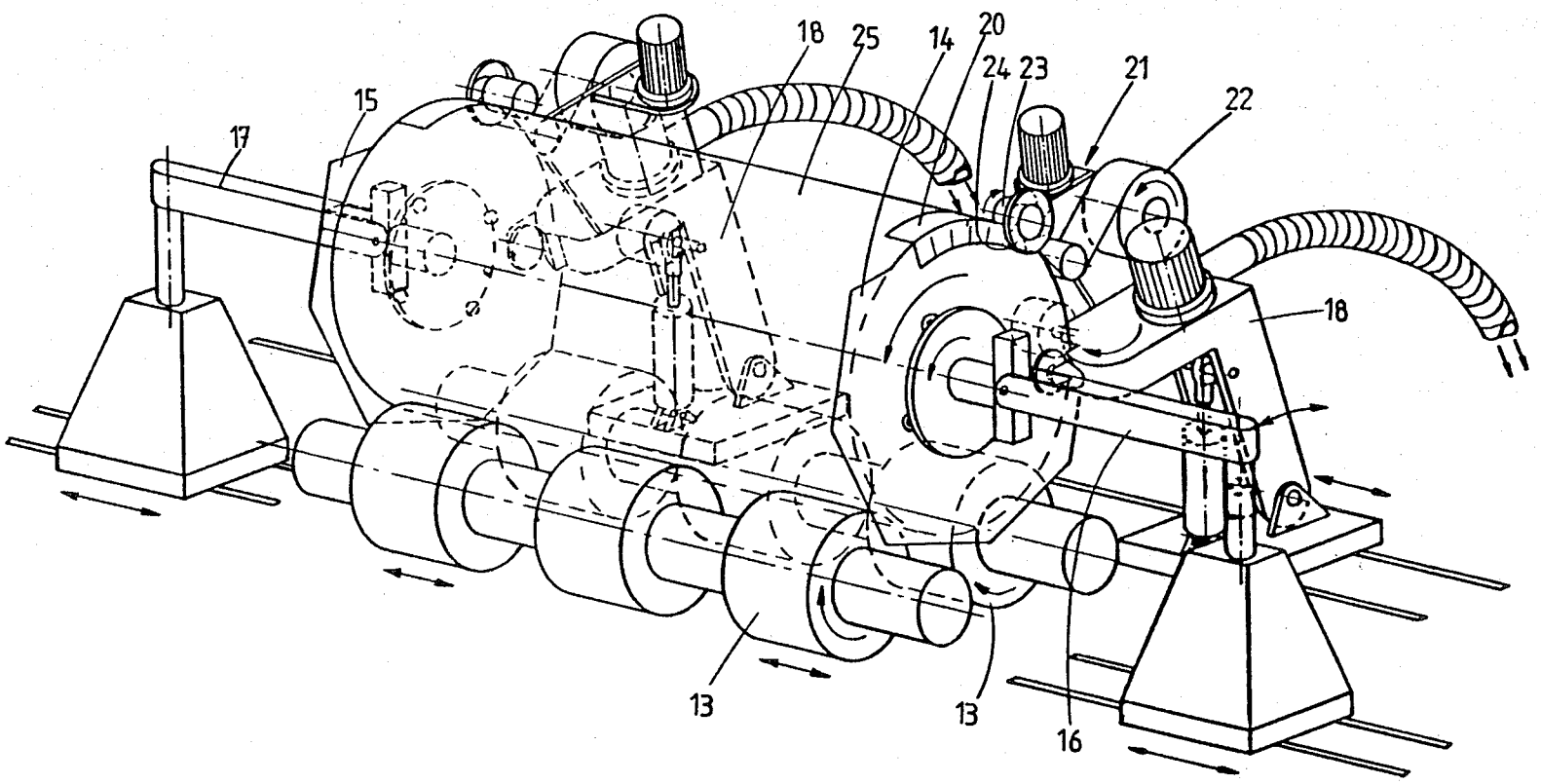
FIG. 2 is a perspective view of a header sheet cutting and securing means according to the invention.

In FIG. 2 the paper roll rests on rotatable rolls 13. Header sheets 14 and 15 the corners of which have been precut and which are bigger than the end surfaces of the roll, have been transferred to the ends of the roll by transfer means 16 and 17. The transfer means catches by suction pads the uppermost header sheet from a header sheet pile, turns it into a vertical position, centers it and moves it to the roll end. The header sheet is cut to the size of the diameter of the roll or a little smaller by cutting off at least the edge extending over the end by means of cutting devices 18 while the roll is rotated.

When the edge of the header sheet is cut, the wrapper and the header are adhered to each other by means of a tape forming a tight joint, a band of adhesive or a corresponding jointing material. In FIG. 2, a tape 20 is fed to the edge of the roll from a tape roll 22 disposed in a jointing device 21. The tape is laid on the roll so that half of the width of the tape extends over the edge of the paper roll. A roller 23 of the jointing device presses the tape against the circumference of the paper roll and its flange 24 turns the part of the tape which extends over the edge against the roll end so that the tape is secured to the edges of the wrapper 25 and the header.

Figure 3:
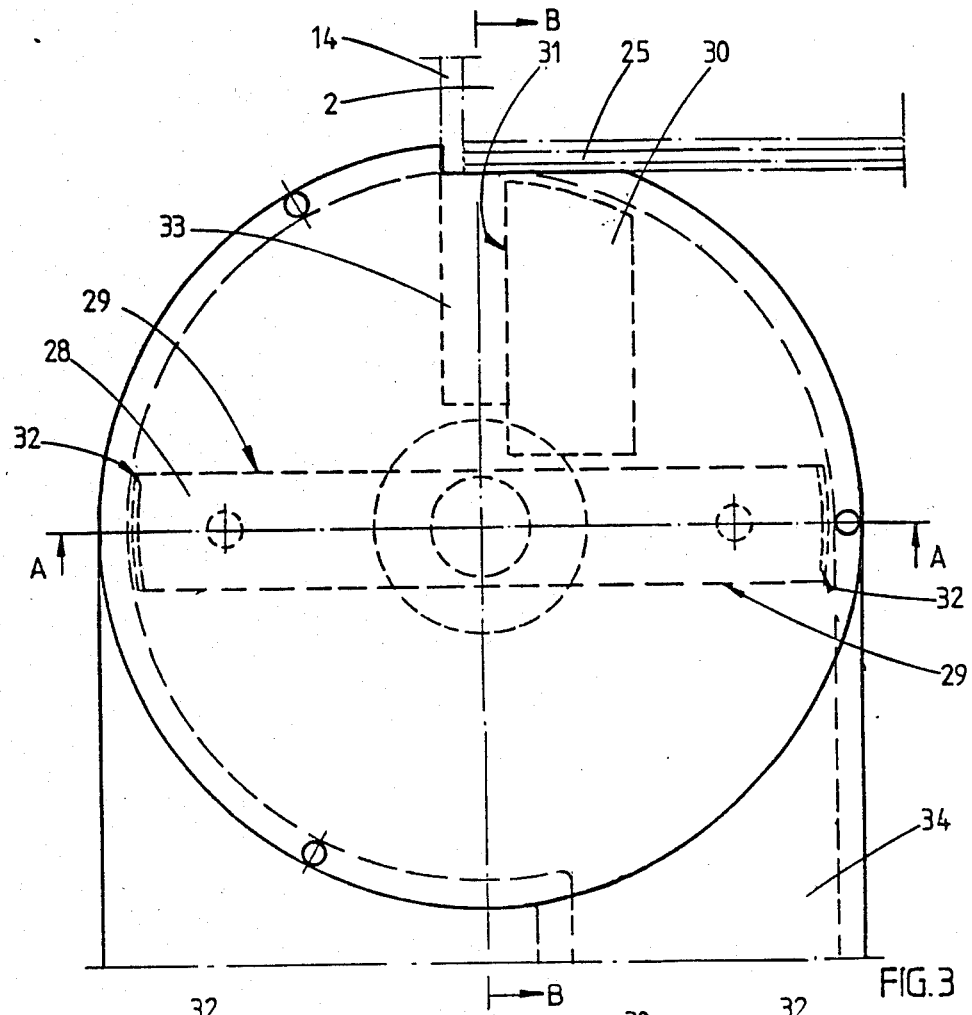
FIG. 3 is a partial top view of the cutting means of FIG. 2 in a bigger scale.
Figure 4:
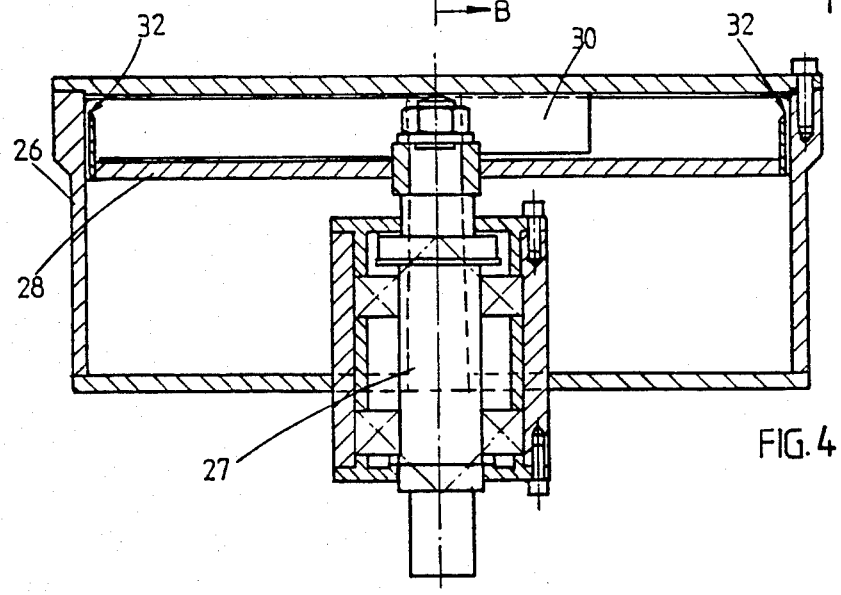
FIG. 4 is a section of FIG. 3 taken on line A—A.
Figure 5:
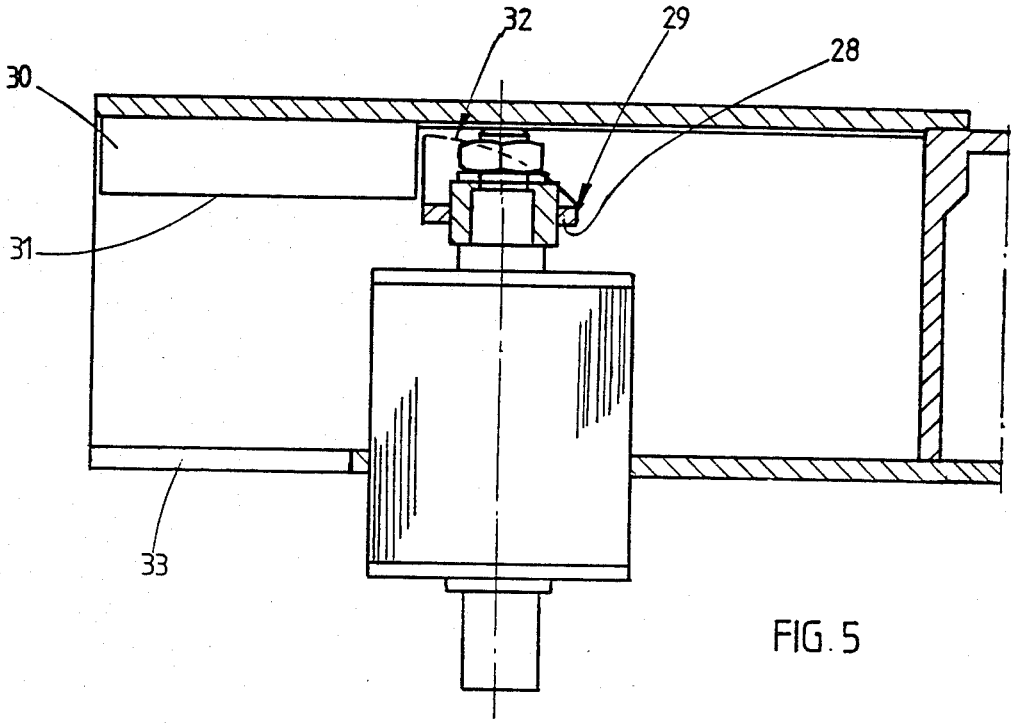
FIG. 5 is a section of FIG. 3 taken on line B—B.

The cutting means for cutting the wrapper sheet according to the width of the paper roll and the header sheet according to the diameter of the paper roll are similar, except that the openings into which the overlapping edges go are disposed in different points. In the cutting means 7 which cut the edge of the wrapper sheet the opening is disposed on the upper surface of the device and is parallel with the axis of the paper roll. In the cutting means 18 and 19 which cut the header sheet, the opening is disposed on the lower surface of the device and is parallel with the end. In the following, there is a description of the cutting means shown in FIGS. 3–5.

The cutting means comprises a blade 28 attached to a rotating axis 27 in a housing 26, in which blade there are cutting edges 29 at a level substantially perpendicular to the rotational axis, which together with a cutting edge 31 of a dead knife 30 cut the edge of the header sheet, and inclined cutting edges 32 in the ends of the blade which cut the edge extending over the end surface of the header sheet.

On the lower surface and the side surface of the housing there is an opening 33 through which the edge of the header sheet 14 goes while the paper roll rotates. The blade of the cutting means cuts the edge of the header sheet to small pieces which are removed through a removal channel 34. If required, suction can be used for removing the crushed material.

The specific embodiment shown is not meant to limit the invention, but numerous modifications may be effected without departing from the scope of the claims. Thus the wrapper and the header can be adhered to each other by means of a thermoplastic substance which is fed on the paper roll in a molten state and which, when solidifying, forms a film covering the edges of the wrapper and the header.

What we claim is:

1. A method for packaging a paper roll or the like in which a wrapping material is wrapped around the roll and headers are secured to the ends of the roll, which consists of the steps of (a) wrapping a wrapper sheet (1) of width greater than the axial length of the roll (2) around the roll, (b) securing the wrapper sheet to the roll, (c) removing the portions (5,6) of the wrapper sheet which extend over the ends of the roll, whereby the width of the wrapper sheet is reduced to the size of the length of the roll, (d) placing header sheets (14,15) of size greater than the end surface of the roll against the ends of the roll, (e) removing at least the edge portion of the header sheets extendng over the end surface and reducing the header sheets to obtain headers of the size of the roll diameter or smaller, while the roll is rotated, (f) securing the headers to the wrapper so that a tight joint is formed.

2. The method according to claim 1, wherein the headers are secured to the wrapper in step (f) by means of a band of adhesive (20) which is adhered to the header and the wrapper and which is placed on the roll (2) so that half of the width of the band extends beyond the edge of the roll and is folded against the end of the roll.

3. The method according to claim 1 wherein the portions removed from the wrapper sheet (1) in step (c) and the edge portions of the header sheets removed in step (e) are cut.

4. The method according to claim 3 wherein the portions removed from the wrapper sheet and the edge portion removed from the header sheets, after being cut are entrained by an air flow.

5. An apparatus for wrapping a paper roll or the like which comprises means for wrapping a wrapper sheet around the roll, means for placing a header sheet against each of the roll ends, means for rotating the roll, cutting means (7,18) provided with cutting tools (28,30) adapted to be placed against the roll for removing the edges of the wrapper sheet (1) and the header sheets (14,15) extending beyond the ends of the roll, means (21) for feeding a jointing material (20) and means for securing the jointing material to the edges of the wrapper and to said header sheets.

6. An apparatus according to claim 5 wherein the means for securing the jointing material to the edges of the wrapper and to the header sheets comprises means for feeding a tape and for laying one half of the tape over the edge of the paper roll, and a roller having a flange (24), said flange being adapted to press the other half of the tape against the edge of the header sheets.

* * * * *